US009903326B2

(12) United States Patent
Stroia et al.

(10) Patent No.: US 9,903,326 B2
(45) Date of Patent: Feb. 27, 2018

(54) FUEL INJECTOR HAVING A MAGNETOSTRICTIVE ACTUATOR DEVICE

(71) Applicant: Cummins Inc., Columbus, IN (US)

(72) Inventors: Bradlee J. Stroia, Columbus, IN (US); William David Daniel, Scipio, IN (US)

(73) Assignee: CUMMINS INC., Columbus, IN (US)

( * ) Notice: Subject to any disclaimer, the term of this patent is extended or adjusted under 35 U.S.C. 154(b) by 260 days.

(21) Appl. No.: 14/712,345

(22) Filed: May 14, 2015

(65) Prior Publication Data

US 2015/0330343 A1 Nov. 19, 2015

Related U.S. Application Data

(60) Provisional application No. 61/993,403, filed on May 15, 2014.

(51) Int. Cl.

| | |
|---|---|
| ***F02M 51/00*** | (2006.01) |
| ***F02M 51/06*** | (2006.01) |
| ***F02M 61/08*** | (2006.01) |
| ***F02M 61/16*** | (2006.01) |
| ***F02M 61/20*** | (2006.01) |

(52) U.S. Cl.

CPC ..... *F02M 51/0603* (2013.01); *F02M 61/08* (2013.01); *F02M 61/167* (2013.01); *F02M 61/20* (2013.01)

(58) Field of Classification Search

CPC ..... F02M 51/0603; F02M 51/0607; F02M 61/08; F02M 61/20

See application file for complete search history.

(56) References Cited

U.S. PATENT DOCUMENTS

| | | | | |
|---|---|---|---|---|
| 5,091,253 | A | 2/1992 | Smith et al. | |
| 6,307,286 | B1 | 10/2001 | Yamazaki et al. | |
| 6,364,221 | B1 | 4/2002 | Czimmek | |
| 7,255,290 | B2 | 8/2007 | Bright et al. | |
| 7,307,371 | B2 | 12/2007 | Jensen et al. | |
| 7,469,878 | B1 | 12/2008 | Richard | |
| 8,113,179 | B1 | 2/2012 | Bright | |
| 8,823,221 | B1 * | 9/2014 | Teter | H01L 41/47 310/26 |
| 2005/0098663 | A1 * | 5/2005 | Ishii | F02M 51/0607 239/584 |
| 2012/0037125 | A1 | 2/2012 | Bright | |
| 2012/0037126 | A1 | 2/2012 | Bright | |

* cited by examiner

*Primary Examiner* — Jason Boeckmann

(74) *Attorney, Agent, or Firm* — Faegre Baker Daniels LLP

(57) ABSTRACT

The present disclosure provides a fuel injector including a magnetostrictive actuator that is capable of precise control of a needle or nozzle valve element. The magnetostrictive actuator is direct-acting on the nozzle valve element, which extends into the magnetostrictive actuator, providing a compact fuel injector configuration that may provide rate-shaping of a fuel injection event.

11 Claims, 6 Drawing Sheets

FUEL INJECTOR HAVING A MAGNETOSTRICTIVE ACTUATOR DEVICE

CROSS-REFERENCE TO RELATED APPLICATIONS

The present application claims the benefit of U.S. Provisional Patent Application Ser. No. 61/993,403, filed May 15, 2014, and entitled "FUEL INJECTOR HAVING A MAGNETOSTRICTIVE ACTUATOR DEVICE," the complete disclosure of which is expressly incorporated by reference herein.

FIELD OF THE DISCLOSURE

The present disclosure relates to a fuel injector, and more particularly, to a fuel injector including a magnetostrictive actuator device.

BACKGROUND OF THE DISCLOSURE

Fuel injectors are provided to control fuel flow during a fuel injection event. Such control may be accomplished by controlling the movement of a needle or nozzle valve element, such as may be accomplished by actuation of a piezoelectric actuator. Improved systems and methods of controlling the actuation of piezoelectric actuators have been developed to better control a needle or nozzle valve element. More recently, magnetostrictive materials have been used in actuator mechanisms to cause the movement of needle or nozzle valve elements.

SUMMARY OF THE DISCLOSURE

This disclosure provides a fuel injector for an internal combustion engine, comprising a fuel injector body, a magnetostrictive actuator, and a nozzle valve element. The fuel injector body includes a longitudinal axis, an upper body portion, a fuel injector cavity, and a nozzle housing having at least one injector orifice positioned at a distal end thereof in communication with the fuel injector cavity. The magnetostrictive actuator extends along the longitudinal axis and is positioned in the fuel injector cavity. The magnetostrictive actuator includes at least one annular magnetostrictive element comprised of a material configured to elongate when under tension and a coil positioned to provide a magnetic field to the at least one annular magnetostrictive element. The nozzle valve element extends along the longitudinal axis and into a first end of the at least one annular magnetostrictive element and out from a second end of the at least one annular magnetostrictive element. The at least one annular magnetostrictive element is extendable, in the presence of the magnetic field generated by the coil, to move the nozzle valve element from a closed position, blocking a fuel flow into the at least one injector orifice from the fuel injector cavity, to an open position, permitting fuel flow into the at least one injector orifice from the fuel injector cavity. The at least one magnetostrictive element is contractable to permit the nozzle valve element to move from the open position to the closed position upon removal of the magnetic field.

This disclosure also provides a fuel injector for an internal combustion engine, comprising a fuel injector body, a magnetostrictive actuator, and a nozzle valve element. The fuel injector body includes a longitudinal axis, an upper body portion, a fuel injector cavity, and a nozzle housing having at least one injector orifice positioned at a nozzle housing distal end in communication with the fuel injector cavity. The magnetostrictive actuator includes a longitudinally extending passage that extends from a first, distal end of the magnetostrictive actuator. The nozzle valve element extends from the nozzle housing distal end into the longitudinally extending passage. The magnetostrictive actuator is operable through magnetostrictive displacement to move the nozzle valve element from a closed position, blocking a fuel flow into the at least one injector orifice from the fuel injector cavity, into an open position, permitting fuel flow into the at least one injector orifice from the fuel injector cavity, and the magnetostrictive actuator is configured to receive a control signal to increase the magnetostrictive displacement.

This disclosure also provides a fuel rate shaping system for an internal combustion engine, comprising a control system and a fuel injector. The control system is configured to generate a rate shaping signal. The fuel injector is configured to receive the rate shaping signal. The fuel injector includes a fuel injector body including a longitudinal axis, a nozzle housing having at least one injector orifice, and a fuel injector cavity. The fuel injector further includes a nozzle valve element positioned in the fuel injector cavity, and a magnetostrictive actuator positioned in the fuel injector cavity to transversely overlap at least a portion of the nozzle valve element along the longitudinal axis and operable to move the nozzle valve element from a closed position in response to the rate shaping signal, blocking a fuel flow into the at least one injector orifice from the fuel injector cavity, to a plurality of open positions, permitting a variable fuel flow rate into the at least one injector orifice from the fuel injector cavity.

This disclosure also provides a fuel injector for an internal combustion engine, comprising a fuel injector body, a first annular magnetostrictive element, a second annular magnetostrictive element, a first annular coupler, a coil, and a nozzle valve element. The fuel injector body includes a longitudinal axis, an upper body portion, a fuel injector cavity, and a nozzle housing having at least one injector orifice positioned at a nozzle housing distal end in communication with the fuel injector cavity. The first annular magnetostrictive element has a longitudinally extending central passage. The first annular coupler is positioned transversely between the first annular magnetostrictive element and the second annular magnetostrictive element. The first annular magnetostrictive element, the second annular magnetostrictive element and the coupler are positioned in the fuel injector cavity between the upper body portion and the at least one injector orifice, and the first annular magnetostrictive element, the second annular magnetostrictive element and the coupler extend along the longitudinal axis. The coil is positioned to provide a magnetic field to the first annular magnetostrictive element and the second annular magnetostrictive element. The nozzle valve element extends along the longitudinal axis and into the central passage. The first annular magnetostrictive element is expandable in the presence of the magnetic field to apply an actuating force to move the first coupler in a direction that is longitudinally away from the at least one injector orifice. The second annular magnetostrictive element is expandable in the presence of the magnetic field to move the nozzle valve element from a closed position, blocking a fuel flow into the at least one injector orifice from the fuel injector cavity, to an open position, permitting fuel flow into the at least one injector orifice from the fuel injector cavity. The first annular magnetostrictive element and the second annular magnetostrictive element are contractable upon removal of the magnetic field to permit the nozzle valve element to move from the open position to the closed position.

Advantages and features of the embodiments of this disclosure will become more apparent from the following detailed description of exemplary embodiments when viewed in conjunction with the accompanying drawings.

DETAILED DESCRIPTION OF THE DRAWINGS

Figure 1:
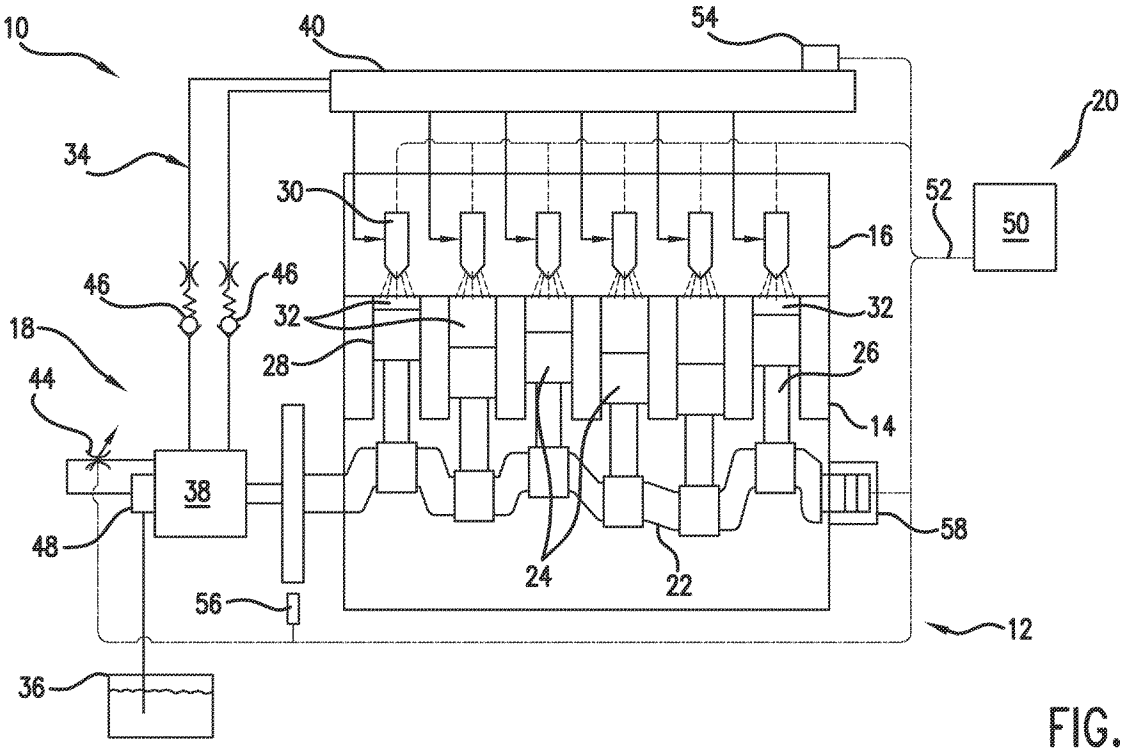
FIG. 1 is a schematic of an internal combustion engine incorporating an exemplary embodiment of a fuel injector of the present disclosure.
Figure 2:
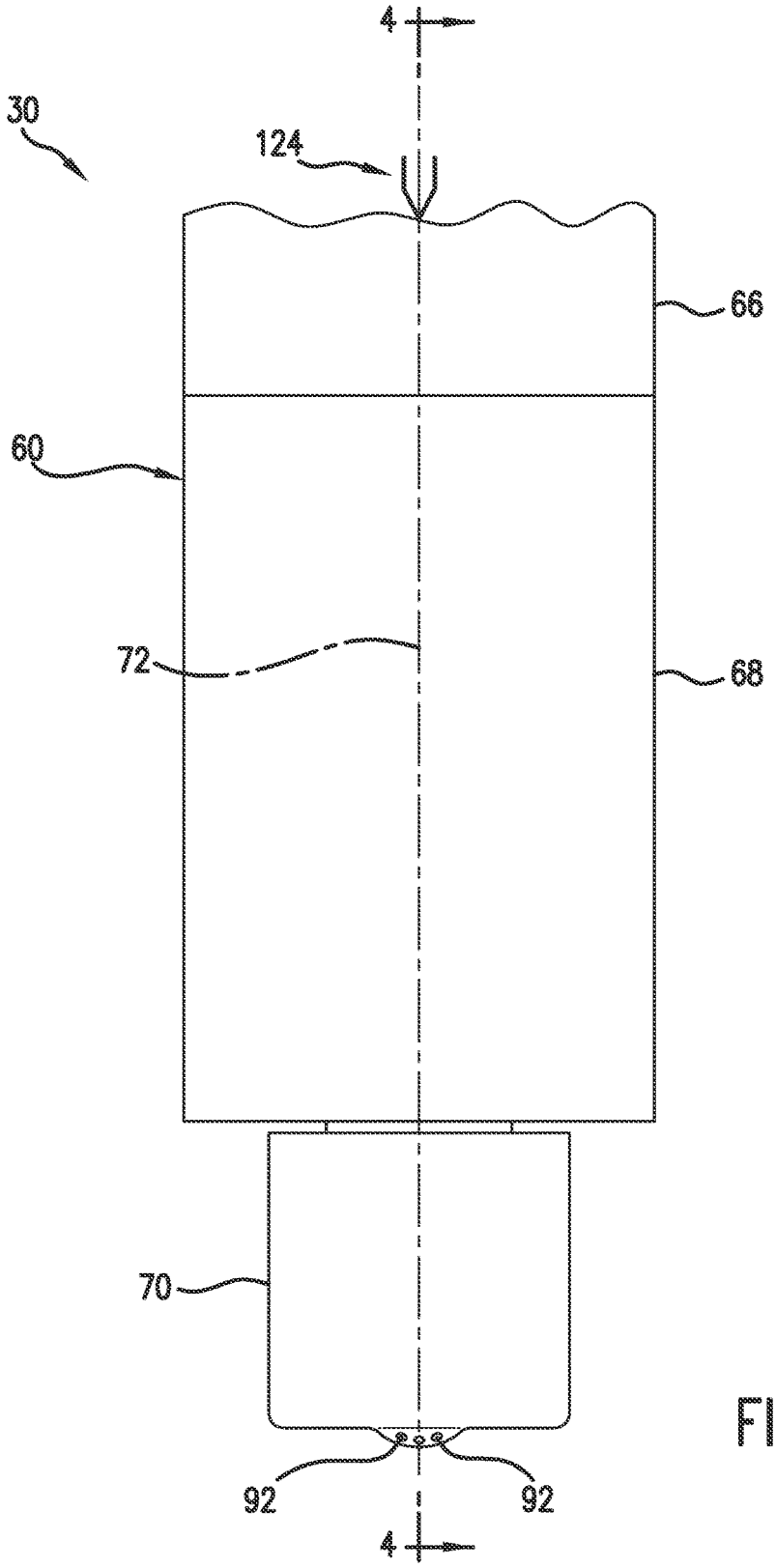
FIG. 2 is an elevation view of a portion of the fuel injector of the internal combustion engine of FIG. 1 in accordance with an exemplary embodiment of the present disclosure.
Figure 3:
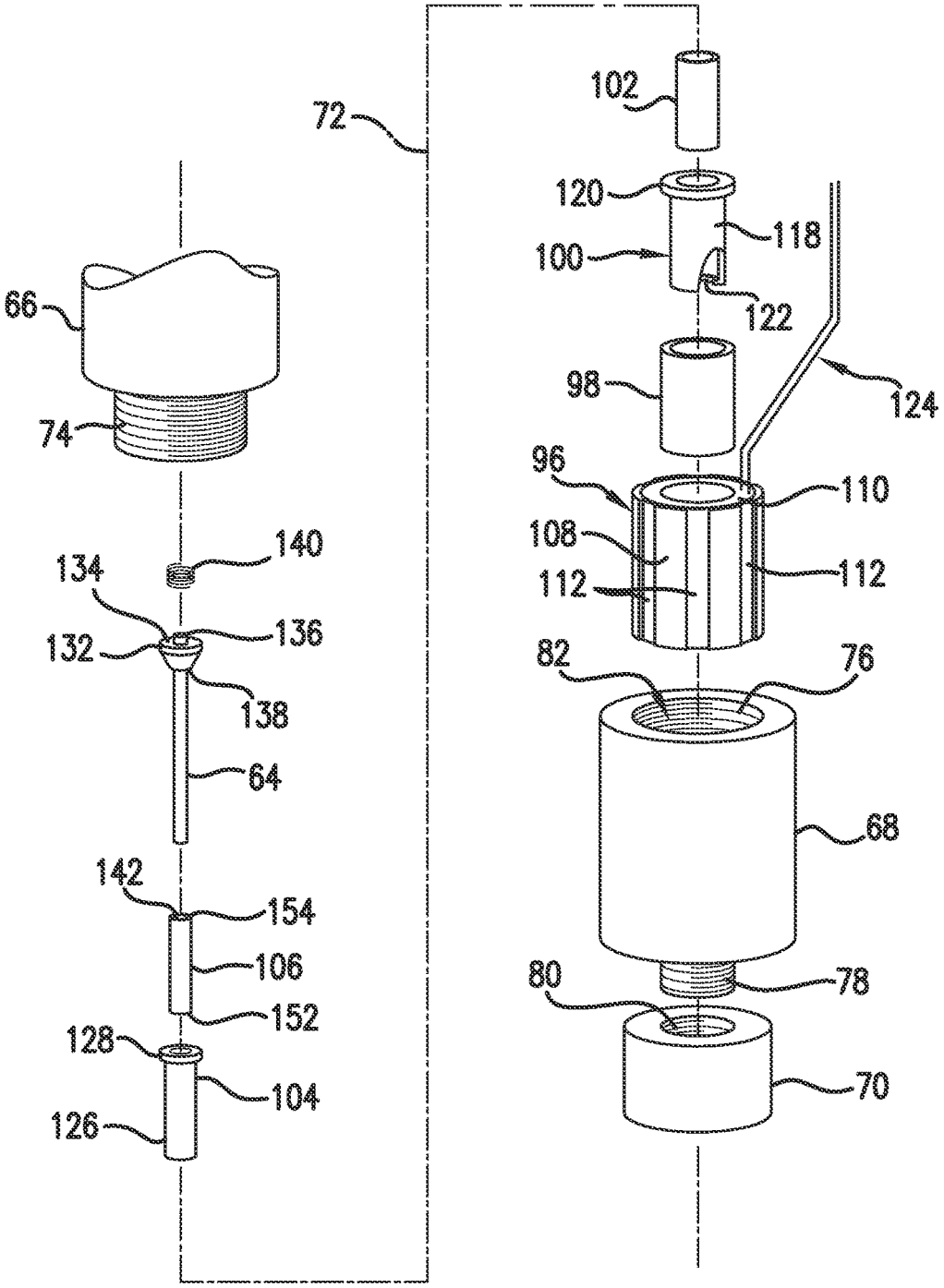
FIG. 3 is an exploded view of the fuel injector of FIG. 2.

Referring to FIG. 1, a portion of an internal combustion engine in accordance with an exemplary embodiment of the present disclosure is shown as a simplified schematic and generally indicated at 10. Engine 10 includes an engine body 12, which includes an engine block 14 and a cylinder head 16 attached to engine block 14, a fuel system 18, and a control system 20. Control system 20 receives signals from sensors located on engine 10 and transmits control signals to devices located on engine 10 to control the function of those devices, such as one or more fuel injectors. The present disclosure provides a fuel injector including a magnetostrictive actuator that is capable of precise control of a needle or nozzle valve element, which provides the ability to perform variable spray atomization and sophisticated rate-shaping of a fuel injection event, i.e., fuel delivery and fuel energy management. Examples of rate-shaping systems and methods are described in U.S. Pat. Nos. 5,619,969, 5,983,863, 6,199,533, and 7,334,741, the entire contents of which are hereby incorporated herein by reference in their entirety.

Engine body 12 includes a crank shaft 22, a plurality of pistons 24, and a plurality of connecting rods 26. Pistons 24 are positioned for reciprocal movement in a plurality of engine cylinders 28, with one piston positioned in each engine cylinder 28. One connecting rod 26 connects each piston 24 to crank shaft 22. As will be seen, the movement of pistons 24 under the action of a combustion process in engine 10 causes connecting rods 26 to move crankshaft 22. A plurality of fuel injectors 30 are positioned within cylinder head 16. Each fuel injector 30 is fluidly connected to a combustion chamber 32, each of which is formed by one piston 24, cylinder head 16, and the portion of engine cylinder 28 that extends between a respective piston 24 and cylinder head 16. Throughout this specification, "inwardly," "distal," and "near" are terms used to describe longitudinal movement in the direction of combustion chamber 32. "Outwardly," "proximate," and "far" are terms used to describe longitudinal movement away from the direction of combustion chamber 32.

Fuel system 18 provides fuel to injectors 30, which is then injected into combustion chambers 32 by the action of fuel injectors 30, forming one or more injection events. The injection event may be defined as the interval that begins with the movement of a nozzle or needle valve element, described in more detail hereinbelow, permitting fuel to flow from fuel injector 30 into an associated combustion chamber 32, until the nozzle or needle valve element move to a closed position to block the flow of fuel from fuel injector 30 into combustion chamber 32. Fuel system 18 includes a fuel circuit 34, a fuel tank 36, which contains a fuel, a high-pressure fuel pump 38 positioned along fuel circuit 34 downstream from fuel tank 36, and a fuel accumulator or rail 40 positioned along fuel circuit 34 downstream from high-pressure fuel pump 38. While fuel accumulator or rail 40 is shown as a single unit or element, accumulator 40 may be distributed over a plurality of elements that transmit or receive high-pressure fuel, such as fuel injector(s) 30, high-pressure fuel pump 38, and any lines, passages, tubes, hoses and the like that connect high-pressure fuel to the plurality of elements. Fuel system 18 may further include an inlet metering valve 44 positioned along fuel circuit 34 upstream from high-pressure fuel pump 38 and one or more outlet check valves 46 positioned along fuel circuit 34 downstream from high-pressure fuel pump 38 to permit one-way fuel flow from high-pressure fuel pump 38 to fuel accumulator 40. Though not shown, additional elements may be positioned along fuel circuit 34. For example, inlet check valves may be positioned downstream from inlet metering valve 44 and upstream from high-pressure fuel pump 38, or inlet check valves may be incorporated in high-pressure fuel pump 38. Inlet metering valve 44 has the ability to vary or shut off fuel flow to high-pressure fuel pump 38, which thus shuts off fuel flow to fuel accumulator 40. Fuel circuit 34 connects fuel accumulator 40 to fuel injectors 30, which receive fuel from fuel accumulator 40 and then provide controlled amounts of fuel to combustion chambers 32. Fuel system 18 may also include a low-pressure fuel pump 48 positioned along fuel circuit 34 between fuel tank 36 and high-pressure fuel pump 38. Low-pressure fuel pump 48 increases the fuel pressure to a first pressure level prior to fuel flowing into high-pressure fuel pump 38.

Control system 20 may include a controller or control module 50 and a wire harness 52. Many aspects of the disclosure are described in terms of sequences of actions to be performed by elements of a computer system or other hardware capable of executing programmed instructions, for example, a general purpose computer, special purpose computer, workstation, or other programmable data processing apparatus. It will be recognized that in each of the embodiments, the various actions could be performed by specialized circuits (e.g., discrete logic gates interconnected to perform a specialized function), by program instructions (software), such as logical blocks, program modules etc. being executed by one or more processors (e.g., one or more microprocessors, a central processing unit (CPU), and/or application specific integrated circuit), or by a combination of both. For example, embodiments can be implemented in hardware, software, firmware, middleware, microcode, or any combination thereof. The instructions can be program code or code segments that perform necessary tasks and can be stored in a non-transitory, machine-readable medium such as a storage medium or other storage(s). A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents.

The non-transitory machine-readable medium can additionally be considered to be embodied within any tangible form of computer readable carrier, such as solid-state memory, a magnetic disk, and an optical disk containing an appropriate set of computer instructions, such as program modules, and data structures that would cause a processor to carry out the techniques described herein. A computer-readable medium may include the following: an electrical connection having one or more wires, magnetic disk storage, magnetic cassettes, magnetic tape or other magnetic storage devices, a portable computer diskette, a random access memory (RAM), a read-only memory (ROM), an erasable programmable read-only memory (e.g., EPROM, EEPROM, or Flash memory), or any other tangible medium capable of storing information.

It should be noted that the system of the present disclosure is illustrated and discussed herein as having various modules and units which perform particular functions. It should be understood that these modules and units are merely schematically illustrated based on their function for clarity purposes, and do not necessarily represent specific hardware or software. In this regard, these modules, units and other components may be hardware and/or software implemented to substantially perform their particular functions explained herein. The various functions of the different components can be combined or segregated as hardware and/or software modules in any manner, and can be useful separately or in combination. Input/output, or I/O, devices or user interfaces including but not limited to keyboards, displays, pointing devices, and the like can be coupled to the system either directly or through intervening I/O controllers. Thus, the various aspects of the disclosure may be embodied in many different forms, and all such forms are contemplated to be within the scope of the disclosure.

Control system 20 may also include an accumulator pressure sensor 54 and a crank angle sensor. While sensor 54 is described as being a pressure sensor, sensor 54 may be other devices that may be calibrated to provide a pressure signal that represents fuel pressure, such as a force transducer, strain gauge, or other device. The crank angle sensor may be a toothed wheel sensor 56, a rotary Hall sensor 58, or other type of device capable of measuring the rotational angle of crankshaft 22 and transmitting a signal representing the rotational angle of crankshaft 22 to control system 20. Control system 20 uses signals received from accumulator pressure sensor 54 and the crank angle sensor to determine which combustion chamber 32 is receiving fuel, which is then used to analyze the signals received from accumulator pressure sensor 54.

Control module 50 may be an electronic control unit or electronic control module (ECM) that may monitor conditions of engine 10 or an associated vehicle in which engine 10 may be located. Control module 50 may be a single processor, a distributed processor, an electronic equivalent of a processor, or any combination of the aforementioned elements, as well as software, electronic storage, fixed lookup tables and the like. Control module 50 may include a digital or analog circuit. Control module 50 may connect to certain components of engine 10 by wire harness 52, though such connection may be by other means, including a wireless system. For example, control module 50 may connect to and provide control signals to inlet metering valve 44 and to fuel injectors 30.

When engine 10 is operating, combustion in combustion chambers 32 causes the movement of pistons 24. The movement of pistons 24 causes movement of connecting rods 26, which are drivingly connected to crankshaft 22, and movement of connecting rods 26 causes rotary movement of crankshaft 22. The angle of rotation of crankshaft 22 is measured by engine 10 to aid in timing of combustion events in engine 10 and for other purposes. The angle of rotation of crankshaft 22 may be measured in a plurality of locations, including a main crank pulley (not shown), an engine flywheel (not shown), an engine camshaft (not shown), or on the camshaft itself. Measurement of crankshaft 22 rotation angle may be made with toothed wheel sensor 56, rotary Hall sensor 58, and by other sensors or techniques. A signal representing the angle of rotation of crankshaft 22, also called the crank angle, is transmitted from toothed wheel sensor 56, rotary Hall sensor 58, or other device to control system 20.

Crankshaft 22 drives high-pressure fuel pump 38 and low-pressure fuel pump 48. The action of low-pressure fuel pump 48 pulls fuel from fuel tank 36 and moves the fuel along fuel circuit 34 toward inlet metering valve 44. From inlet metering valve 44, fuel flows downstream along fuel circuit 34 through inlet check valves (not shown) to high-pressure fuel pump 38. High-pressure fuel pump 38 moves the fuel downstream along fuel circuit 34 through outlet check valves 46 toward fuel accumulator or rail 40. Inlet metering valve 44 receives control signals from control system 20 and is operable to block fuel flow to high-pressure fuel pump 38. Inlet metering valve 44 may be a proportional valve or may be an on-off valve that is capable of being rapidly modulated between an open and a closed position to adjust the amount of fuel flowing through the valve.

Fuel pressure sensor 54 is coupled to fuel accumulator 40 and is capable of detecting or measuring the fuel pressure in fuel accumulator 40. Fuel pressure sensor 54 sends signals indicative of the fuel pressure in fuel accumulator 40 to control system 20. Control system 20 provides control signals to fuel injectors 30 that determine operating parameters for each fuel injector 30, such as the length of time fuel injectors 30 operate and the number of fueling pulses per a firing or injection event period, which determines the amount of fuel delivered by each fuel injector 30.

Referring to FIGS. 2-5, fuel injector 30 includes a fuel injector body 60, a magnetostrictive actuator or magnetostrictive actuator assembly 62 positioned in fuel injector body 60, and a nozzle or needle valve element 64 positioned for reciprocal movement in fuel injector body 60. The reciprocal movement of nozzle valve element 64 is caused by a magnetostrictive actuating force applied by magnetostrictive actuator 62. Because magnetostrictive actuator 62 contacts nozzle valve element 64 and the movement of components in magnetostrictive actuator 62 applies the magnetostrictive actuating force on nozzle valve element 64, thereby moving nozzle valve element 64, magnetostrictive actuator 62 may be described as providing direct acting control over nozzle valve element 64. Direct acting control contrasts to conventional fuel injector control designs that indirectly move nozzle valve element 64, such as through a valve arrangement. Fuel injector body 60 includes an upper housing or barrel portion 66, an actuator housing 68, a nozzle element housing 70, a longitudinal axis 72, and a fuel injector cavity 82. Nozzle element housing 70 includes one or more fuel injector orifices 92 positioned at a distal end thereof. Fuel injector cavity 82 includes an actuator cavity 84, which receives or positions magnetostrictive actuator 62, and a nozzle element cavity 86, which is in fluid communication with fuel injector orifices 92. Nozzle valve element 64 extends along longitudinal axis 72 from actuator cavity 84 into nozzle element cavity 86.

Upper housing portion 66 and nozzle element housing 70 are fixedly connected or attached to actuator housing 68. In the exemplary embodiment, upper housing portion 66 includes an upper housing thread 74 and actuator housing 68 includes a mating first actuator housing thread 76, and upper housing portion 66 attaches to actuator housing 68 by engaging upper housing thread 74 with first actuator housing thread 76. Also in the exemplary embodiment, nozzle element housing 70 includes a nozzle element housing thread 80 and actuator housing 68 includes a mating second actuator housing thread 78, and nozzle element housing 70 attaches to actuator housing 68 by engaging nozzle housing thread 80 with second actuator housing thread 78. When upper housing portion 66 and nozzle element housing 70 are attached to actuator housing 68, nozzle valve element 64 is positioned longitudinally between upper housing portion 66 and nozzle element housing 70.

Fuel injector 30 further includes a fuel delivery circuit 88 that connects fuel from fuel system 18 to combustion chambers 32. Fuel delivery circuit 88 includes a longitudinally extending fuel delivery passage 90 that is formed in upper housing portion 66, actuator cavity 84, and nozzle element cavity 86. During a fuel injection event, which occurs when nozzle valve element 64 moves along longitudinal axis 72 away from an inner surface 94 of nozzle element housing 70 to permit fuel flow through fuel injector orifices 92 until a time when nozzle valve element 64 moves longitudinally to block fuel flow through fuel injector orifices 92, fuel flows from fuel system 18 into one or more longitudinally extending fuel delivery passages 90. From longitudinally extending fuel delivery passage(s) 90, the fuel flows into actuator cavity 84, then into nozzle element cavity 86, and, after travelling to a distal end of nozzle element cavity 86, through fuel injector orifices 92 into combustion chamber 32.

Movement of nozzle valve element 64 is effected or caused by the actuating force exerted on nozzle valve element 62 by magnetostrictive actuator 62. Magnetostrictive actuator 62 includes a coil, which may be included as part of a coil assembly 96, and a magnetostrictive element or component. In the exemplary embodiment, magnetostrictive actuator 62 includes coil assembly 96, a first annular magnetostrictive component or element 98, a first annular carrier component or element 100, which is shown partially cutaway in FIG. 3 to permit viewing of an interior portion of first annular carrier component 100, a second annular magnetostrictive component or element 102, a second annular carrier component or element 104, and a third annular magnetostrictive component or element 106. As described hereinabove, magnetostrictive actuator 62, which includes the aforementioned components of magnetostrictive actuator 62, is positioned in actuator cavity 84, which is part of fuel injector cavity 82. First annular carrier component or element 100 and second annular carrier component or element 104 are fabricated of steel in an exemplary embodiment.

Coil assembly 96 includes an annular non-magnetic spacer 108 and an annular coil 110 positioned within spacer 108, each of which extend along longitudinal axis 72. Annular coil 110 includes a pair of wires 124 that connect annular coil 110 to control system 20. Annular non-magnetic spacer 108 may include a plurality of longitudinally extending grooves or passages 112 that permit fuel to flow from an upper or proximate end of actuator cavity 84 to a lower or distal end of actuator cavity 84. Thus, fuel delivery circuit 88 may include longitudinally extending grooves or passages 112. Actuator housing 68 may include a plurality of radially extending grooves 114 that permit fuel flow from longitudinally extending grooves or passages 112 along a distal end of magnetostrictive actuator 62 and then into nozzle element cavity 86.

First annular magnetostrictive component 98 has a tube-like shape that extends along longitudinal axis 72, and in the exemplary embodiment, first annular magnetostrictive component 98 is formed of the magnetostrictive material galfenol. Galfenol is beneficial as compared to commonly used terfenol in that galfenol is more physically robust than terfenol. For example, galfenol is a ductile material configured to longitudinally expand or elongate when under certain tensile forces, withstand certain compressive forces without plastic deformation, and may be annealed or machined. Illustrative magnetostrictive actuator 62 may include galfenol and is configured to move nozzle valve element 64 a longitudinal distance sufficient for the anticipated fueling needs of engine 10. First annular magnetostrictive component 98 is slidingly positioned within the interior of annular coil 110 and contacts a radially extending interior surface 116 formed on actuator housing 68.

First annular carrier component 100 includes a first longitudinally extending central or tube portion 118, a first upper or proximate lip 120 that extends radially outwardly from first central or tube portion 118, and a first lower or distal lip 122 that extends radially inwardly from first central or tube portion 118. First annular carrier component 100 is slidably positioned within the interior of first annular magnetostrictive component 98 so that upper or proximate lip 120 contacts a proximate end of first annular magnetostrictive component 98.

Second annular magnetostrictive component 102 has a tube-like shape that extends along longitudinal axis 72, and in the exemplary embodiment, second annular magnetostrictive component 102 is formed of the magnetostrictive material galfenol. Second annular magnetostrictive component 98 is slidingly positioned within the interior of first annular carrier component 100 so that a distal end of second annular magnetostrictive component 102 contacts first lower distal lip 122 of first annular carrier component 100.

Second annular carrier component 104 includes a second longitudinally extending central or tube portion 126, a second upper or proximate lip 128 that extends radially outwardly from second central or tube portion 126, and a second lower or distal lip 130 that extends radially inwardly from second central or tube portion 118. Second annular carrier component 104 is slidably positioned within the interior of second annular magnetostrictive component 102 so that second upper or proximate lip 126 contacts a proximate end of second annular magnetostrictive component 102.

Third annular magnetostrictive component 106 has a tube-like shape that extends along longitudinal axis 72, and in the exemplary embodiment, third annular magnetostrictive component 106 is formed of the magnetostrictive material galfenol. Third annular magnetostrictive component 106 includes a first, distal opening 152, a second, proximate opening 154, and a central passage 142 extending from first, distal opening 152 to second, proximate opening 154. Third annular magnetostrictive component 106 is slidingly positioned within the interior of second annular carrier component 104 so that a distal end of third annular magnetostrictive component 106 contacts second lower distal lip 130 of second annular carrier component 104.

As should be apparent from the foregoing description and from the figures, coil assembly 96, first annular magnetostrictive component 98, first annular carrier component 100, second annular magnetostrictive component 102, second carrier component 104, and third annular magnetostrictive component 106 are positioned transversely or radially adjacent to each other, beginning at the outermost radial distance or portion with coil assembly 96 and ending at the innermost radial distance or portion with third annular magnetostrictive component 106, also thus making coil assembly 96, first annular magnetostrictive component 98, first annular carrier component 100, second annular magnetostrictive component 102, second annular carrier component 104, and third annular magnetostrictive component 106 concentric. Furthermore, first annular magnetostrictive component 98, first annular carrier component 100, second annular magnetostrictive component 102, second carrier component 104, and third annular magnetostrictive component 106 are positioned transversely between coil assembly 96 and nozzle valve element 64.

Nozzle valve element 64 includes a radially extending protrusion 132. Radially extending protrusion 132 includes an upper or proximate surface 134, a cylindrical guide 136 that extends longitudinally away from proximate surface 134, and a distal surface 138. A proximate end of third annular magnetostrictive component 106 contacts distal surface 138 of radially extending protrusion 132. A bias spring 140 is positioned between upper housing 66 and a proximate end of nozzle valve element 64. More specifically, bias spring 140 contacts proximate surface 134 of radially extending protrusion 132. Bias spring 140 is kept in position by cylindrical guide 136, which extends into an interior of bias spring 140. Bias spring 140 assists in keeping nozzle valve element 64 in the closed position, and also keeps third annular magnetostrictive component 106, and thus the other components of magnetostrictive actuator 62, biased in a distal direction by applying a bias force to proximate surface 134 of nozzle valve element 64 in the absence of a magnetostrictive actuator control signal generated by controller 50 and applied to annular coil assembly 96. Furthermore, bias spring 140 assists in moving nozzle valve element 64 from an open position toward the closed positioned when the magnetostrictive actuator control signal is removed from magnetostrictive actuator 62, or when the amplitude of the magnetostrictive actuator control signal is decreased.

Figure 4:
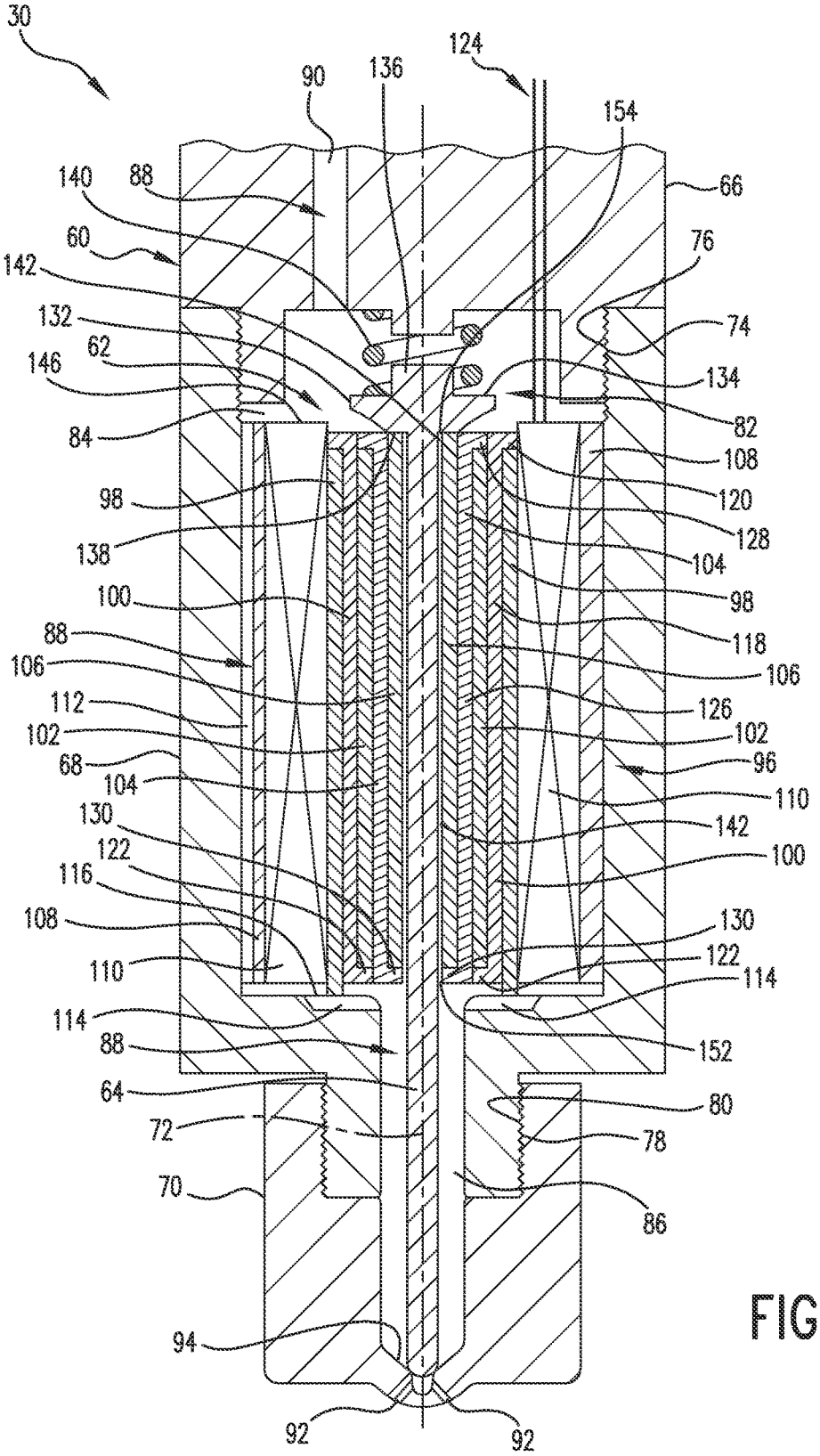
FIG. 4 is a cross sectional view of the fuel injector of FIG. 2, taken along the line 4-4, with a nozzle or needle valve element in a closed position.
Figure 5:
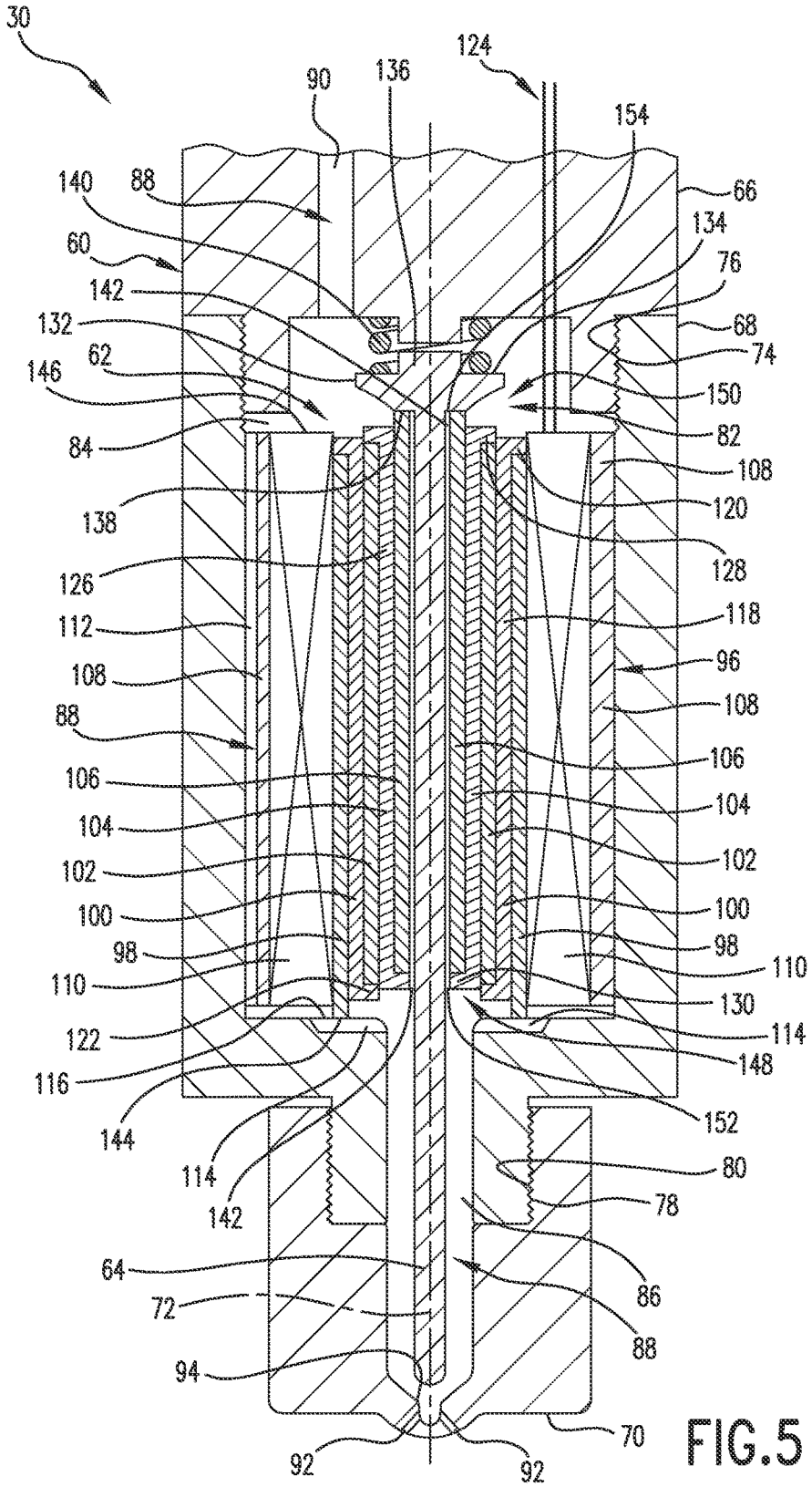
FIG. 5 is a cross sectional view of the fuel injector of FIG. 4 with the nozzle or needle valve element in an open position.

Magnetostrictive actuator 62 includes a first, distal end 144, and a second, proximate end 146. First, distal end 144 includes a first, distal end face 148 and second, proximate end 146 includes a second, proximate end face 150. In the exemplary embodiment, distal end face 148 and proximate end face 150 are non-planar faces. As best seen in FIGS. 4 and 5, nozzle valve element 64 extends longitudinally into magnetostrictive actuator 62 from distal end 144 of magnetostrictive actuator 62. More specifically, nozzle valve element 64 extends through first, distal end face 148 into central passage 142 formed in magnetostrictive actuator 62, and more specifically, in third annular magnetostrictive component 106.

In the exemplary embodiment nozzle valve element 64 extends longitudinally from nozzle element cavity 86 through first, distal end face 148 of magnetostrictive actuator 62, through central passage 142 entirely through magnetostrictive actuator 62, extending longitudinally away from second, proximate end face 150 of magnetostrictive actuator 62. Thus, nozzle valve element extends from a first side of magnetostrictive actuator 62 and longitudinally beyond a second side of magnetostrictive actuator 62. Thus, in the exemplary embodiment magnetostrictive actuator 62 is positioned longitudinally between a proximate end of nozzle valve element 64 and a distal end of nozzle valve element 64. In an alternative embodiment, nozzle valve element 64 may extend into distal end 144 of magnetostrictive actuator 62 and terminate within an interior of magnetostrictive actuator 62. In the alternative embodiment, bias spring 140 may interface with third annular magnetostrictive component 106 instead of with nozzle valve element 64. In both the exemplary embodiment and the alternative embodiment, magnetostrictive actuator 62 and the components positioned within magnetostrictive actuator 62 transversely overlap nozzle valve element 64 as well as each other. The aforementioned arrangement of magnetostrictive actuator 62 and nozzle valve element 64, in particular, the extension of nozzle valve element 64 into magnetostrictive actuator 62, provides fuel injector 30 with a compact arrangement that makes fuel injector 30 significantly smaller than conventional fuel injectors having a piezoelectric actuator or other embodiments of a magnetostrictive actuator.

Magnetostrictive actuator 62 functions as follows. Magnetostrictive actuator 62 receives the magnetostrictive actuator control signal from control system 20 by way of coil wires 124. The magnetostrictive actuator control signal causes annular coil 110 to generate a magnetic field that extends through first annular magnetostrictive component 98, second annular magnetostrictive component 102, and third annular magnetostrictive component 106. The application of the magnetic field on, or presence of the magnetic field through, each magnetostrictive component causes each magnetostrictive component to extend or elongate longitudinally. The amount of extension of each magnetostrictive component is linear and proportional to the amplitude of the magnetostrictive actuator control signal received by magnetostrictive actuator 62. In other words, the amount of extension, or magnetostrictive displacement, of each magnetostrictive component may be increased or decreased by the control signal. Because the longitudinal movement of nozzle valve element 64 controls the flow of fuel from fuel delivery circuit 88 into injector orifice(s) 92, and because the amplitude of the control signal determines the amount of longitudinal movement, magnetostrictive actuator 62 is configured to provide rate shaping to the fuel flow into combustion chamber 32. As first annular magnetostrictive component 98 extends, first annular magnetostrictive component 98 applies a force or pushes against first upper or proximate lip 120, forcing first annular carrier component 100 to move longitudinally in a direction that is toward the proximate end of fuel injector 30. The movement of first annular carrier component 100 causes first lower distal lip 122 to apply a force to move second annular magnetostrictive component 102, which then applies a force to second upper lip 128 to move second annular carrier component 104. Second lower distal lip 130 of second annular carrier component 104 then applies a force to third annular magnetostrictive component 106, causing third annular magnetostrictive component 106 to move longitudinally, applying a force or pushing against protrusion distal surface 138, forcing nozzle valve element 64 to move longitudinally. The longitudinal movement caused by the extension of first annular magnetostrictive component 98 is toward the proximate end of fuel injector 30, which thus forces and moves nozzle valve element 64 away from fuel injector orifice(s) 92, permitting fuel to flow from nozzle element cavity 86 into combustion chamber 32.

Second annular magnetostrictive component 102 also extends longitudinally toward the proximate end of fuel injector 30 in the presence of the magnetic field generated by annular coil 110, contacting second upper or proximate lip 128 of second annular carrier component 104, applying a force to move second annular carrier component 104 longitudinally with respect to first annular magnetostrictive component 98 and first annular carrier component 100. The expansion or extension of second annular magnetostrictive component 102 toward the proximate end of fuel injector 30 causes the proximate end of second annular magnetostrictive component 102 to extend longitudinally beyond the proximate end of first annular magnetostrictive component 98. Thus, second annular magnetostrictive component 102 and second annular carrier component 104 appear to telescope with respect to first annular magnetostrictive component 98. The longitudinal movement of second annular carrier component 104 applies a force to cause second lower distal lip 130 to push against third annular magnetostrictive component 106, moving third annular magnetostrictive component 106 longitudinally toward the proximate end of fuel injector 30. The longitudinal movement of third annular magnetostrictive component 106 by the extending action of second annular magnetostrictive component 102 is also relative to first annular magnetostrictive component 98 and first annular carrier component 100, and the contact of third annular magnetostrictive component 106 with protrusion distal surface 138 moves nozzle valve element 64, which is an additive movement to the movement caused by first annular magnetostrictive component 98.

Third annular magnetostrictive component 106 also extends longitudinally toward the proximate end of fuel injector 30 by the application or presence of the magnetic field generated by annular coil 110, contacting and applying a force to protrusion distal surface 138 and moving nozzle valve element 64 longitudinally toward the proximate end of fuel injector 30. The movement caused by third annular magnetostrictive component 106 is additive to the movement caused by first annular magnetostrictive component 98 and second annular magnetostrictive component 102, thus, nozzle valve element 64 is movable by an amount sufficient to provide all anticipated fueling rates required by engine 10. In other words, the magnetostrictive displacement may be multiplied by adding the movement of third annular magnetostrictive component 106 to the movement of first and second annular magnetostrictive components 98, 102. More particularly, the movement of third annular magnetostrictive component 106 causes the proximate end of third annular magnetostrictive component 106 to move longitudinally beyond the proximate end of first annular magnetostrictive component 98 and second annular magnetostrictive component 102 in a proximate direction, appearing to telescope with respect to first annular magnetostrictive component 98 and second annular magnetostrictive component 102. As previously noted, when the magnetostrictive actuator control signal is removed from magnetostrictive actuator 62, first annular magnetostrictive component 98, second magnetostrictive component 102, and third magnetostrictive component 104 each contract, or are contractable. As first annular magnetostrictive component 98, second magnetostrictive component 102, and third magnetostrictive component 104 each contract, nozzle valve element 64 is permitted to move toward the closed position, which is assisted by the bias force applied by bias spring 140.

Because each annular magnetostrictive component extends longitudinally with respect to at least one adjacent component, for example, first annular magnetostrictive component 98 extends relative to coil assembly 96, second annular magnetostrictive component 102 extends relative to first annular carrier component 100, and third annular magnetostrictive component 106 extends relative to second annular carrier component 104, magnetostrictive actuator 62 may be described as moving in a telescoping manner. The telescoping movement may be best seen by comparing FIG. 5 to FIG. 4. It should also be understood that the force applied by each magnetostrictive element is part of the magnetostrictive actuating force. Thus, the magnetostrictive actuating force is the total force exerted by first annular magnetostrictive component 98, second annular magnetostrictive component 102, and third annular magnetostrictive component 106 as each magnetostrictive component expands under the influence, presence, or application of the magnetic field generated by annular coil 110.

Figure 6:
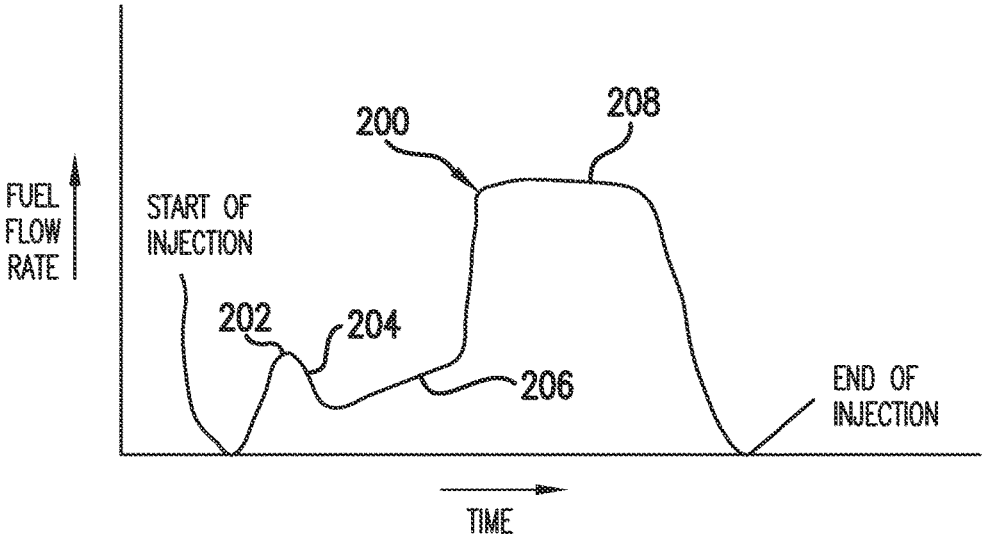
FIG. 6 is a graph showing an exemplary fuel injector flow rate profile enabled by the exemplary embodiment of the present disclosure.

Referring to FIG. 6, an exemplary fuel flow rate profile 200 in accordance with an exemplary embodiment of the present disclosure is shown that is made possible by the exemplary embodiment magnetostrictive actuator 62 of the present disclosure. Control system 20 generates a rate shaping signal that is received by magnetostrictive actuator 62, which moves nozzle valve element 64 in response to the rate shaping signal beginning with a start of fuel injection. The movement of nozzle valve element 64 in response to the rate shaping signal causes fuel flow into combustion chamber 32 to vary, creating a flow rate profile, such as flow rate profile 200. Flow rate profile 200 includes a first flow rate peak 202 shortly after a start of injection, which is followed by a flow rate decrease 204. Fuel flow rate profile 200 then includes a fuel rate increase ramp 206, followed by a plateau 208, which terminates with an end of injection. Fuel flow rate profile 200 describes an injection event. The overall shape of fuel flow rate profile 200 is similar to a boot-shape injection profile, though modified with features, e.g., first flow rate peak 202 and fuel rate increase ramp 206, made possible by magnetostrictive actuator 62. It should be understood that fuel flow rate profile 200 is but one of an infinite number of fuel flow rate profiles made possible by the ability to precisely control the movement of nozzle valve element 64 using magnetostrictive actuator 62. First flow rate peak 202 represents an initial quantity of fuel flowing into combustion chamber 32. The initial quantity of fuel expands across combustion chamber 32, followed by fuel supplied during fuel rate increase ramp 206, and fuel supplied during plateau 208. The initial quantity of fuel may be advantageous in fuel flow around a periphery of combustion chamber 32, with the fuel flow during fuel rate increase ramp 206 providing a uniform spread of fuel in combustion chamber 32. Once the initial flow of fuel occurs, the fuel flow during plateau 208 fills combustion chamber 32 to optimize the fuel flow mixture throughout combustion chamber 32. Thus, one benefit to the magnetostrictive actuator of the present disclosure is to provide precise fuel flow control throughout a fuel injection event.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

What is claimed is:

1. A fuel injector for an internal combustion engine, comprising:

a fuel injector body including a longitudinal axis, an upper body portion, a fuel injector cavity, and a nozzle housing having at least one injector orifice positioned at a distal end thereof in communication with the fuel injector cavity;

a magnetostrictive actuator extending along the longitudinal axis and positioned in the fuel injector cavity, the magnetostrictive actuator including at least a first annular magnetostrictive element, a second magnetostrictive element, and a carrier component positioned transversely between the first and second annular magnetostrictive elements, and at least one of the first and second magnetostrictive elements is comprised of a galfenol material, and the magnetostrictive actuator further includes a coil positioned to provide a magnetic field to the first and second annular magnetostrictive elements; and a nozzle valve element extending along the longitudinal axis and into a first end of the first annular magnetostrictive element and out from a second end of the first annular magnetostrictive element, the first and second annular magnetostrictive elements being extendable in the presence of the magnetic field generated by the coil to move the nozzle valve element from a closed position, blocking a fuel flow into the at least one injector orifice from the fuel injector cavity, to an open position, permitting fuel flow into the at least one injector orifice from the fuel injector cavity, and the first and second magnetostrictive elements being contractable to permit the nozzle valve element to move from the open position to the closed position upon removal of the magnetic field.

2. The fuel injector of claim 1, wherein the at first and second annular magnetostrictive elements are configured to elongate when under tension.

3. The fuel injector of claim 1, further including a bias spring positioned longitudinally between a proximate end of the nozzle valve element and the upper body portion to apply a bias force to the nozzle valve element.

4. The fuel injector of claim 1, wherein the magnetostrictive actuator includes three annular magnetostrictive elements and a second carrier component positioned transversely between a second two of the three annular magnetostrictive elements.

5. A fuel injector for an internal combustion engine, comprising:

a fuel injector body including a longitudinal axis, an upper body portion, a fuel injector cavity, and a nozzle housing having at least one injector orifice positioned at a nozzle housing distal end in communication with the fuel injector cavity;

a first annular magnetostrictive element having a longitudinally extending central passage, a second annular magnetostrictive element, and a first annular coupler positioned transversely between the first annular magnetostrictive element and the second annular magnetostrictive element, the first annular magnetostrictive element, the second annular magnetostrictive element and the coupler positioned in the fuel injector cavity between the upper body portion and the at least one injector orifice, and the first annular magnetostrictive element, the second annular magnetostrictive element and the coupler extending along the longitudinal axis;

a coil positioned to provide a magnetic field to the first annular magnetostrictive element and the second annular magnetostrictive element; and a nozzle valve element extending along the longitudinal axis and into the central passage, the first annular magnetostrictive element being expandable in the presence of the magnetic field to apply an actuating force to move the first coupler in a direction that is longitudinally away from the at least one injector orifice, and the second annular magnetostrictive element being expandable in the presence of the magnetic field to move the nozzle valve element from a closed position, blocking a fuel flow into the at least one injector orifice from the fuel injector cavity, to an open position, permitting fuel flow into the at least one injector orifice from the fuel injector cavity, and the first annular magnetostrictive element and the second annular magnetostrictive element being contractable upon removal of the magnetic field to permit the nozzle valve element to move from the open position to the closed position.

6. The fuel injector of claim 5, wherein first annular magnetostrictive element includes a distal end and a proximate end, and the nozzle valve element extends into the distal end and extends from the proximate end.

7. The fuel injector of claim 5, further including a bias spring positioned longitudinally between a proximate end of the nozzle valve element and the upper body portion to apply a bias force to the nozzle valve element.

8. The fuel injector of claim 5, further including a third annular magnetostrictive element positioned transversely between the second annular magnetostrictive element and the coil, and a second coupler positioned transversely between the second annular magnetostrictive element and the third annular magnetostrictive element.

9. The fuel injector of claim 5, wherein at least one of the first and second annular magnetostrictive elements includes a material selected from the group consisting of gallium, iron, nickel, copper, manganese, cobalt, terbium, and dysprosium.

10. The fuel injector of claim 5, wherein at least one of the first and second annular magnetostrictive elements is comprised of one of galfenol and terfenol.

11. The fuel injector of claim 1, wherein at least one of the first and second annular magnetostrictive elements is exposed to the nozzle valve element.

* * * * *